United States Patent [19]

Borg

[11] Patent Number: 5,029,897

[45] Date of Patent: Jul. 9, 1991

[54] SKI POLE GRIP WITH TIMEPIECE

[75] Inventor: James C. Borg, Eugene, Oreg.

[73] Assignee: Ski-Time Corporation, Eugene, Oreg.

[21] Appl. No.: 491,301

[22] Filed: Mar. 9, 1990

[51] Int. Cl.[5] ..... A63C 17/26

[52] U.S. Cl. ..... 280/816; 280/821; 135/66

[58] Field of Search ..... 280/821, 819, 816, 809; 135/65, 66; 368/10, 110

[56] References Cited

U.S. PATENT DOCUMENTS

| | | | |
|---|---|---|---|
| D. 248,985 | 8/1978 | Spiri | 221/230 |
| 4,082,302 | 4/1978 | Albrecht | 280/816 |
| 4,111,444 | 9/1978 | Clements, Jr. | 280/816 |
| 4,731,766 | 3/1988 | Bunyea | 368/10 |
| 4,762,340 | 8/1988 | Addison, Jr. | 280/810 |
| 4,930,810 | 6/1990 | Addison, Jr. | 280/816 |

FOREIGN PATENT DOCUMENTS

| | | |
|---|---|---|
| 2638671 | 3/1978 | Fed. Rep. of Germany . |
| 2578074 | 8/1986 | France . |

*Primary Examiner*—Andres Kashnikow
*Assistant Examiner*—Richard Camby
*Attorney, Agent, or Firm*—Chernoff, Vilhauer, McClung & Stenzel

[57] ABSTRACT

A ski pole grip has a timepiece sealingly and resiliently mounted within its upper end so that the rear surface of the timepiece is sealed by the chamber against exposure to moisture and the timepiece is resiliently movable with respect to the chamber in response to the selective application of force against the front surface of the timepiece. The rear surface of the timepiece includes selectively actuatable control elements for changing the time display in response to the resilient movement of the timepiece with respect to the chamber.

10 Claims, 2 Drawing Sheets

SKI POLE GRIP WITH TIMEPIECE

BACKGROUND OF THE INVENTION

This invention relates to ski poles and ski pole grips, and particularly to the provision of a timepiece sealingly and resiliently mounted thereon.

It has been known in the past to provide ski pole grips with timepieces, such as watches or stopwatches, mounted on the grip with externally accessible buttons or other control devices connected by movable mechanical linkages with the timepieces for selectively controlling the time display. Such prior art devices are shown, for example, in the following publications:

U.S. Pat. No. 4,082,302
U.S. Pat. No. 4,111,444
U.S. Pat. No. 4,731,766
U.S. Pat. No. 4,762,340
U.S. Design Pat. No. 248,985
French Pat. publication No. 2,578,074
West German Pat. publication No. 2638671 A principal problem of all of these prior art structures is that the externally accessible buttons or other control devices, and their movable mechanical linkages to the timepieces, provide avenues through which moisture encountered in the skiing environment can gain access to the timepiece and interfere with its proper operation. Another problem is that the buttons or other control devices are too small for a skier to manipulate with a gloved finger or fingers, or are too complicated to enable economical manufacture.

What is needed, therefore, is a ski pole grip having a timepiece which is effectively sealed against exposure to moisture despite the fact that it is also selectively controllable by the skier to change its time display. Moreover, the selective control mechanism should be capable of easy manipulation by a skier's gloved finger, and be of a simple, economical construction.

SUMMARY OF THE INVENTION

The present invention accomplishes all of the foregoing objectives in a mutually-compatible manner by providing a ski pole grip, having a chamber sealingly and resiliently mounting a timepiece so that a control surface of the timepiece is sealed by the chamber against exposure to moisture and the timepiece is resiliently movable with respect to a portion of the chamber in response to the selective application of force against the timepiece. The control surface of the timepiece has at least one selectively actuatable control element thereon for changing the time display, and the aforementioned portion of the chamber has a contact surface for selectively actuating the control element in response to resilient movement of the timepiece relative thereto by the application of force against the timepiece.

The sealing, by the chamber, of the control surface and thus the selectively actuatable control element also renders the control element inaccessible. However, it is nevertheless still selectively actuatable by virtue of the resilient movement of the timepiece relative to the chamber and the resultant interaction of the control element with the contact surface on the interior of the chamber. Moreover, since the force necessary to actuate the control element need merely be applied generally against the timepiece, rather than specifically against a small control device such as a button, selective changing of the time display can easily be accomplished with a gloved finger. Furthermore, the structure is extremely simple and economical to manufacture.

The foregoing and other objectives, features, and advantages of the invention will be more readily understood upon consideration of the following detailed description of the invention, taken in conjunction with the accompanying drawings.

DETAILED DESCRIPTION OF THE INVENTION

Figure 1:
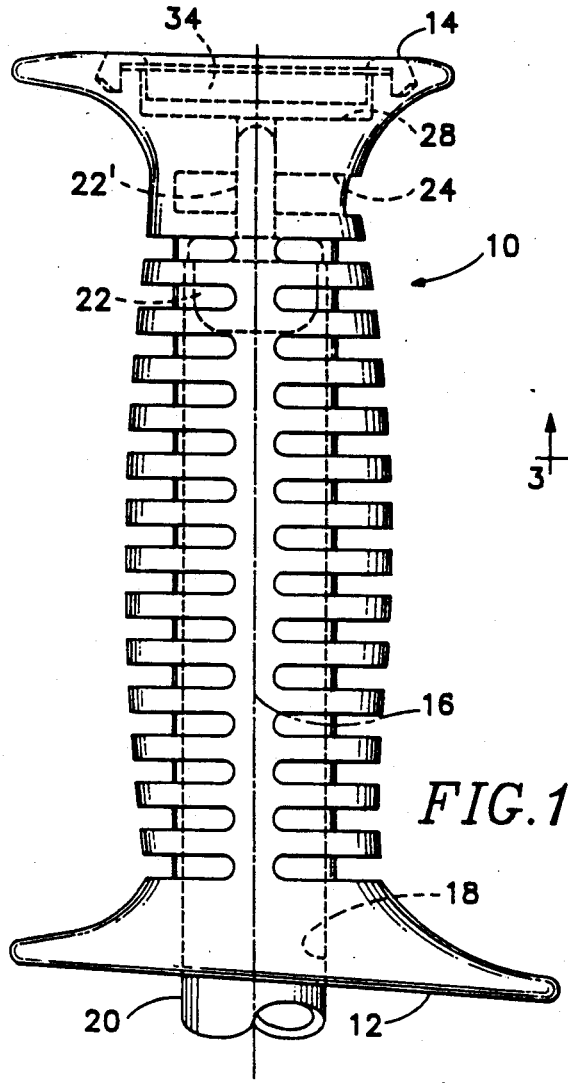
FIG. 1 is a side view of one exemplary embodiment of a ski pole grip constructed in accordance with the present invention.
Figure 2:
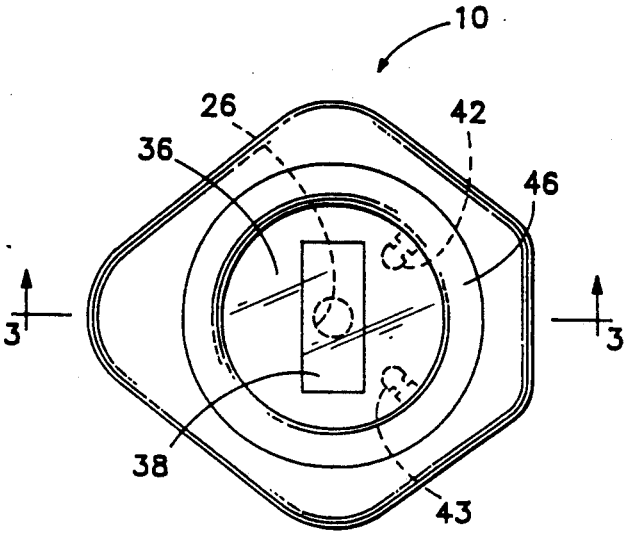
FIG. 2 is a top view of the grip of FIG. 1.
Figure 3:
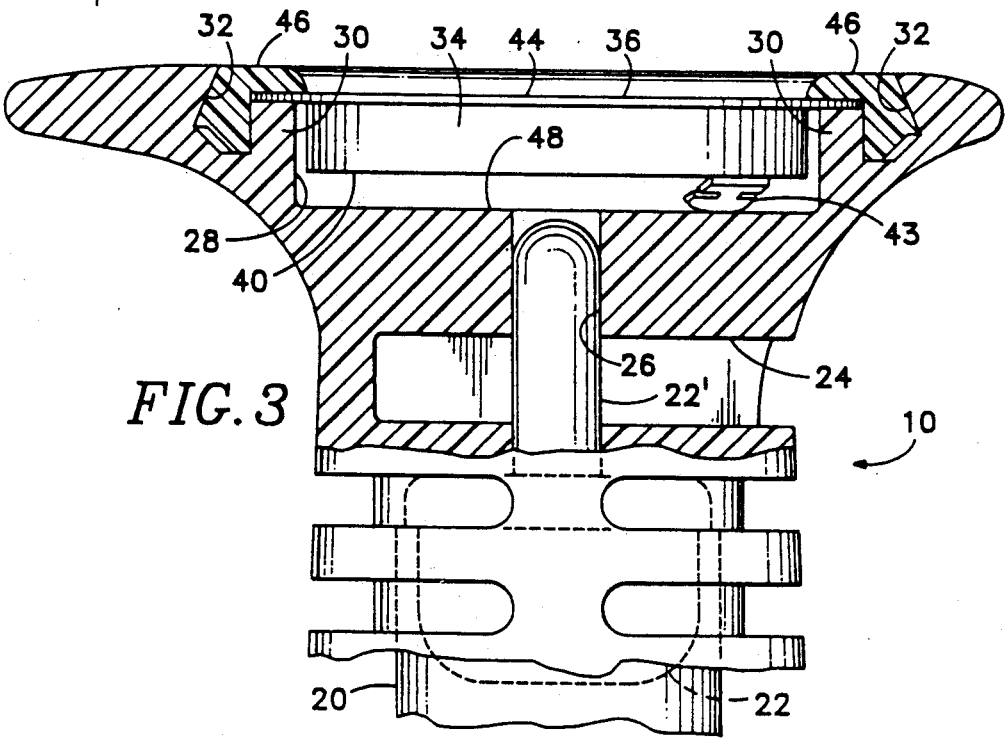
FIG. 3 is an enlarged partially sectional view taken along line 3—3 of FIG. 2.

With respect to the embodiment of FIGS. 1-3, a ski pole grip designated generally as 10 comprises a resilient, moisture-impervious, vinyl elongate body having a first, or lower, end 12, a second, or upper, end 14, and a longitudinal axis 16 extending therebetween. Emerging from the lower end 12 is an axial bore 18 into which an elongate tubular ski pole 20 is matingly fitted so as to extend generally in the same direction as the axis 16. With reference to FIG. 3, the top of the tubular pole 20 has an insert 22 fitted therein having a strap anchoring post 22' extending upwardly therefrom through a strap insertion slot 24 and sealingly into a tight-fitting bore 26 in the grip body. The post 22' extends through apertures in a pair of straps (not shown) inserted into the slot 24 to anchor the straps therein.

The upper end 14 of the grip body has a chamber 28 formed integrally therein. The chamber 28 has an upstanding resilient periphery 30 surrounded by a peripheral channel 32 having an outer wall which is beveled inwardly toward the opening at the top of the channel. Inserted in the chamber 28 is a timepiece, such as a battery-powered digital watch 34, having a front surface 36 with a time display 38 and a rear surface 40 with a pair of selectively actuated control elements 42, 43 thereon for selectively changing the time display. In the case of a digital watch such as 38, such control elements 42, 43 may be conventional "select" and "set" elements comprising resilient conductive tabs which, when actuated by deforming them upwardly into contact with a ground or reference terminal (not shown) on the rear surface 40 of the watch, cause a change in the time display such as an intermittently flashing hour or minute figure (in the case of a "select" control element), or a serially changing hour or minute figure (in the case of a "set" control element).

The digital watch 34 has a conventional moisture-impervious plastic lens 44 on its front surface which matingly rests atop the resilient periphery 30 of the chamber 28 and is held in place by an annular, moisture-impervious retaining ring 46 having a beveled cross section for tightly fitting into the channel 32 by resilient deformation of the channel. The retaining ring 46 holds the lens 44 tightly between the retaining ring and the resilient periphery 30 of the chamber 28, thereby sealing the rear surface 40 of the watch 34, including the control elements 42 and 43, from exposure to moisture.

By sealing the rear surface 40 of the watch 34 against exposure to moisture, the chamber 28 also renders the control elements 42 and 43 inaccessible. However the control elements 42 and 43 are still selectively actuatable by virtue of the fact that the resilient periphery 30 of the chamber 28 permits resilient movement of the watch 34 selectively toward and away from an underlying contact surface 48 of the chamber 28. Thus, by the skier's pressing his thumb against one side of the lens 44 of the watch and thereby tilting one side of the watch toward the contact surface 48, the control element 42 will be deformed upwardly by the contact surface and thus will be actuated. Conversely, by the skier's pressing his thumb against the opposite side of the lens 44, the control element 43 will likewise be deformed upwardly and thus actuated.

Figure 4:
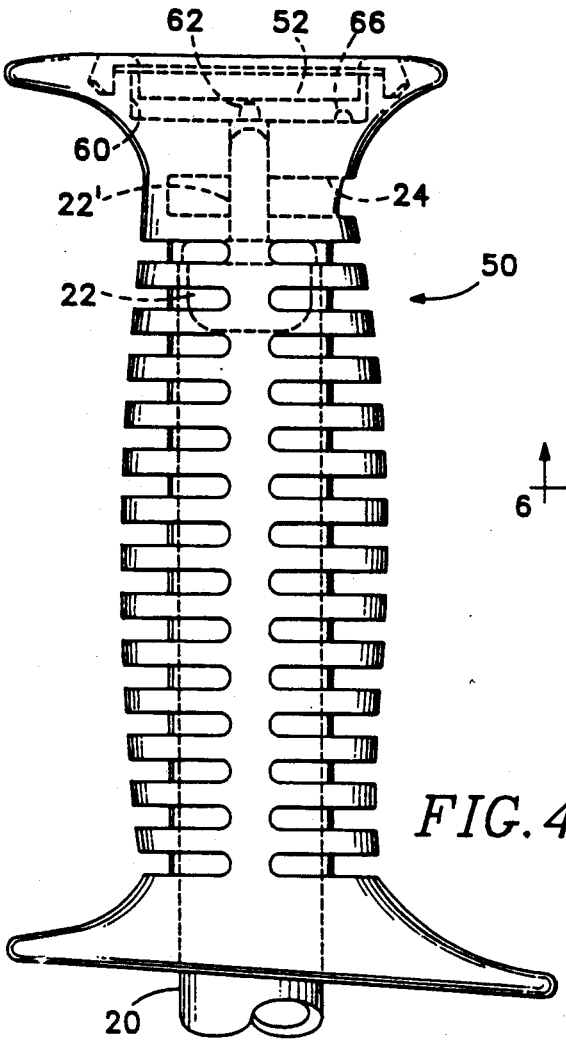
FIG. 4 is a side view of a further exemplary embodiment of a ski pole grip constructed in accordance with the present invention.
Figure 5:
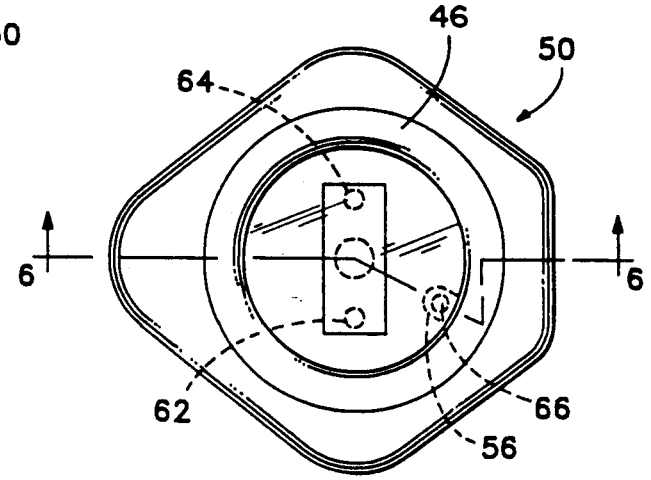
FIG. 5 is a top view of the grip of FIG. 4.
Figure 6:
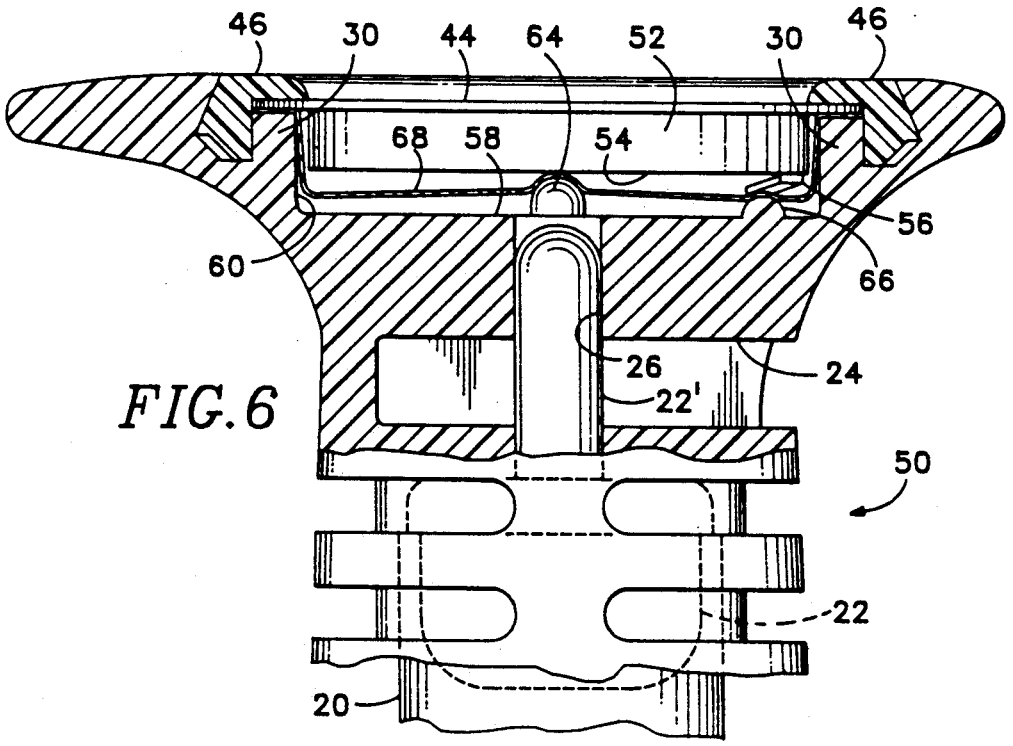
FIG. 6 is an enlarged partially sectional view taken along line 6—6 of FIG. 5.

FIGS. 4–6 show another embodiment of the invention similar in all respects to the embodiment of FIGS. 1–3 except for the variations discussed below. One variation is that the ski pole grip, indicated generally as 50, is designed to mount a battery-powered digital stopwatch 52 rather than an ordinary watch. Because of this, the rear surface 54 of the stopwatch has only a single resilient conductive control element 56, rather than a pair of control elements as in the previous embodiment. Deformation of the control element 56 upwardly into contact with a ground or reference terminal (not shown) on the rear surface 54 of the stopwatch 52 alternatively starts, stops and resets the stopwatch. Because a somewhat more responsive control may be desired for a stopwatch, the underlying surface 58 of the chamber 60 at the upper end of the grip includes several upward protrusions 62, 64 and 66, respectively. Protrusions 62 and 64 form a fulcrum about which the stopwatch 52 will tilt when the skier's thumb is pressed against the lens 44 of the stopwatch. Protrusion 66 partially deforms the control element 56 upwardly even when the skier's thumb is not pressed against the stopwatch lens, so that only a relatively small tilting movement of the stopwatch under the pressure of the skier's thumb is necessary to actuate the control element 56. Such greater responsiveness also enhances the moisture seal provided by the resilient periphery 30 of the chamber 60, since less deformation of the periphery is required to actuate the control element. Similar protrusions could also be used in the embodiment of FIGS. 1–3 if a more responsive control, requiring less tilting movement of the watch relative to the chamber to actuate the control elements, is desired.

To further enhance the moisture seal, particularly where frequent actuation of the control elements is expected as in a stopwatch, a thin plastic film pocket 68 can optionally be provided to cover the rear surface and control elements of the timepiece as shown in FIG. 6, the periphery of the pocket 68 being sealingly adhered to the peripheral underside of the lens 44. Such thin, flexible, moisture-impervious film further seals the rear surface and control element or elements of the timepiece from moisture without interfering with the actuation of the control elements.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow

What is claimed is:

1. Apparatus sealingly mounting a selectively controllable timepiece comprising:

(a) an elongate body having a longitudinal axis extending between a first end and a second end of said body;

(b) means adjacent said first end of said body for attaching an elongate ski pole to said body so that said pole extends generally in the same direction as said axis;

(c) a timepiece, having a front surface for showing a time display and a rear surface having control means thereon for selectively changing said time display, said timepiece being mounted adjacent said second end of said body;

(d) said second end of said body including chamber means having a resiliently deformable peripheral member affixed to said body, said peripheral member having peripheral surface means in engagement with said timepiece for both sealing said rear surface of said timepiece against exposure to moisture and yieldably supporting said timepiece on said body so that said timepiece is resiliently movable with respect to a portion of said chamber means by deformation of said peripheral member in response to the selective application of force against said front surface of said timepiece; and (e) contact means on said portion of said chamber means for selectively contacting said control means and thereby changing said time display in response to resilient movement of said timepiece with respect to said portion of said chamber means by said selective application of force against said front surface of said timepiece, said control means comprising electrically conductive means movably mounted on said timepiece for moving in response to contact with said contact means and thereby changing said time display.

2. The apparatus of claim 1 wherein said contact means is integral with said chamber means.

3. The apparatus of claim 1 wherein said chamber means is integral with said body.

4. The apparatus of claim 1 wherein said front surface of said timepiece is substantially normal to said longitudinal axis of said body.

5. The apparatus of claim 1, further including an elongate ski pole attached to said first end of said body and extending substantially normal to said front surface of said timepiece so as to enable said pole longitudinally to resist said selective application of force against said front surface of said timepiece.

6. Apparatus sealingly mounting a selectively controllable timepiece comprising:

(a) a body;

(b) a timepiece, having a first surface for showing a time display and a second surface having selectively actuatable control means thereon for selectively changing said time display;

(c) said body including chamber means for sealingly and resiliently mounting said timepiece on said body so that said second surface of said timepiece is sealed by said chamber means against exposure to moisture and said timepiece is resiliently movable with respect to a portion of said chamber means in response to the selective application of force against said timepiece;

(d) contact means on said portion of said chamber means for selectively actuating said control means in response to resilient movement of said timepiece with respect to said portion of said chamber means by said selective application of force against said timepiece; and (e) said control means comprising electrically conductive means movably mounted on said timepiece for moving in response to contact with said contact means and thereby changing said time display.

7. The apparatus of claim 6 wherein said chamber means includes means defining a resiliently movable periphery sealingly engaging and resiliently mounting said timepiece for movement with respect to said portion of said chamber means.

8. The apparatus of claim 6 wherein said contact means is integral with said chamber means.

9. The apparatus of claim 6 wherein said chamber means is integral with said body.

10. The apparatus of claim 6 wherein said chamber means includes a resiliently deformable peripheral member affixed to said body for both sealing said rear surface of said timepiece against exposure to moisture and yieldably supporting said timepiece on said body.

* * * * *